US008820239B2

(12) United States Patent
Lee et al.

(10) Patent No.: US 8,820,239 B2
(45) Date of Patent: Sep. 2, 2014

(54) REVERSE OFFSET PRINTING METHOD USING PLURAL PARTIAL OFF

(71) Applicant: Korea Institute of Machinery & Materials, Daejeon (KR)

(72) Inventors: Taik Min Lee, Daejeon (KR); In Young Kim, Daejeon (KR); Dong Woo Kang, Daejeon (KR)

(73) Assignee: Korea Institute of Machinery & Materials, Daejeon (KR)

( * ) Notice: Subject to any disclaimer, the term of this patent is extended or adjusted under 35 U.S.C. 154(b) by 0 days.

(21) Appl. No.: 13/621,360

(22) Filed: Sep. 17, 2012

(65) Prior Publication Data

US 2013/0255519 A1 Oct. 3, 2013

(30) Foreign Application Priority Data

Apr. 3, 2012 (KR) ..... 10-2012-0034394

(51) Int. Cl.
*B41F 1/16* (2006.01)
*B41L 17/08* (2006.01)

(52) U.S. Cl.
USPC ..... 101/492; 101/217; 101/251

(58) Field of Classification Search
CPC ..... H05K 3/1275; H05K 2203/0534
USPC ..... 101/158–166, 251, 252, 492, 153, 154, 101/215, 217
See application file for complete search history.

(56) References Cited

U.S. PATENT DOCUMENTS

| | | | | |
|---|---|---|---|---|
| 6,261,670 | B1 | 7/2001 | Hakomori | |
| 7,189,766 | B2 | 3/2007 | Takahashi | |
| 8,365,663 | B2 * | 2/2013 | Kim et al. | 101/492 |
| 2004/0202778 | A1 | 10/2004 | Nishiguchi | |
| 2011/0132527 | A1 * | 6/2011 | Kook et al. | 156/219 |
| 2012/0156850 | A1 | 6/2012 | Yang | |

FOREIGN PATENT DOCUMENTS

| | | |
|---|---|---|
| JP | 2003-017261 | 1/2003 |
| JP | 2004-178915 | 6/2004 |
| JP | 2005-301146 | 10/2005 |
| JP | 2005-338806 | 12/2005 |
| JP | 2007-268713 | 10/2007 |
| JP | 2009-233894 | 10/2009 |
| KR | 10-2002-0027154 | 4/2002 |
| KR | 10-2004-0054411 | 6/2004 |
| KR | 10-2004-0059102 | 7/2004 |
| KR | 10-0825476 | 4/2008 |
| KR | 10-0881231 | 7/2008 |
| KR | 10-0851045 | 8/2008 |
| KR | 10-2010-0002068 | 1/2010 |
| KR | 10-0940402 | 1/2010 |
| KR | 10-2010-0083394 | 7/2010 |
| KR | 10-2010-0107595 | 10/2010 |
| KR | 10-1094864 | 12/2011 |
| KR | 10-2012-0028579 | 3/2012 |
| KR | 10-1144610 | 5/2012 |
| KR | 10-1154007 | 5/2012 |

* cited by examiner

*Primary Examiner* — Ren Yan
*Assistant Examiner* — Justin Olamit
(74) *Attorney, Agent, or Firm* — Lexyoume IP Meister, PLLC

(57) ABSTRACT

The present invention relates to a reverse offset printing method, and more particularly, to a reverse offset printing method in a partial off type capable of accurately transferring a pattern to a cliche to achieve more precise minute printing by separately performing removal for each shear region of a functional ink even though the pattern is minute.

4 Claims, 10 Drawing Sheets

REVERSE OFFSET PRINTING METHOD USING PLURAL PARTIAL OFF

CROSS-REFERENCE TO RELATED APPLICATION

This application claims priority to and the benefit of Korean Patent Application No. 10-2012-0034394 filed in the Korean Intellectual Property Office on Apr. 3, 2012, the entire contents of which are incorporated herein by reference.

BACKGROUND OF THE INVENTION (a) Field of the Invention

The present invention relates to a reverse offset printing method, and more particularly to a reverse offset printing method in a partial off type capable of accurately transferring a pattern to a cliche to achieve more precise minute printing by separately performing removal for each shear region of a functional ink even though the pattern is minute.

(b) Description of the Related Art

In general, a cliche (C, see FIG. 1) performs patterning while coming into contact with a blanket B coated with a functional ink and offs (removes) an unnecessary pattern other than a desired shape.

Hereinafter, a reverse offset electronic printing apparatus 10 will be described as an example, as illustrated in FIG. 1.

The reverse offset electronic printing apparatus 10 includes a blanket B coated with a functional ink I and a cliche C coming into contact with the blanket B to remove an unnecessary pattern.

That is, as illustrated in FIG. 1, the blanket B coated with the functional ink I is first prepared.

The functional ink I may be coated on the blanket B through widely known methods such as spin coating, slit coating and the like.

The above-mentioned blanket B coated with the functional ink I is brought into contact with the cliche C including a groove portion CV.

In this case, the functional ink coming into contact with the groove portion CV remains on the blanket B, and the functional ink coming into contact with a contact surface CA of the cliche C is transferred to the cliche C.

That is, a part desired to be patterned remains on the blanket B and is transferred to a substrate S, and then printing is performed.

Meanwhile, in a recently spotlighted electronic printing field, a width of the pattern is equal to or smaller than scores of um in many cases.

Accordingly, as illustrated in FIG. 2, a width L of the groove portion CV of the cliche C is also equal to or smaller than scores of um.

However, as described above, as the width of the pattern becomes more minute, a size of the pattern remaining on the blanket B becomes very small in comparison with a size of the functional ink transferred to the cliche C from the blanket B.

In this case, the functional ink which should remain on the blanket B and then be finally transferred to the substrate does not remain on the blanket B and is transferred to the cliche C sometimes.

The above case may be generated by a phenomenon in which since adhesive force between the blanket B and the functional ink is weaker than shear force of the function ink as illustrated in FIG. 3, a connection portion II (hereinafter, referred to as a shear region) between the functional ink which should remain on the blanket B and the functional ink transferred to the cliche C cannot be cut when the blanket B and the cliche C are separated from each other.

In this case, the functional ink which should remain on the blanket B is taken to the cliche C, and thus accurate printing is not possible.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a reverse offset printing method in a partial off type capable of accurately transferring a pattern to a cliche to achieve more precise minute printing by separately performing removal for each shear region of a functional ink even though the pattern is minute.

An exemplary embodiment of the present invention provides a reverse offset printing method including: providing a blanket having one surface coated with a functional ink including a pattern region and shear regions surrounding the pattern region; bringing a first cliche having one surface on which a first contact portion coming into contact with the functional ink including a part of the shear regions is formed into contact with the blanket; separating the blanket from the first cliche to remove the functional ink coming into contact with the first contact portion from the blanket; bringing a second cliche having one surface on which a second contact portion coming into contact with the functional ink including the other part of the shear regions is formed into contact with the blanket; and separating the blanket from the second cliche to remove the functional ink coming into contact with the second contact portion from the blanket.

In the reverse offset printing method according to the present invention, the pattern region may include a plurality of square cross section shapes spaced apart from each other and arranged in a grid pattern, the first cliche may include a plurality of first contact portions formed in a horizontal direction of the grid pattern and first groove portions engraved between the first contact portions, and the second cliche may include a plurality of second contact portions formed in a vertical direction of the grid pattern and second groove portions engraved between the second contact portions.

In the reverse offset printing method according to the present invention, a width of the groove portion of the first cliche may be equal to a vertical width of a square.

In the reverse offset printing method according to the present invention, a width of the groove portion of the second cliche may be equal to a horizontal width of a square.

In the reverse offset printing method according to the present invention, the pattern region may be formed by a region where the first groove portion and the second groove portion overlap each other.

In the reverse offset printing method according to the present invention, the functional ink remaining on the blanket after the blanket may be separated from the second cliche corresponds to the pattern region.

In this case, the reverse offset printing method may include, after the separating of the blanket from the second cliche, transferring the pattern region to a substrate.

According to the exemplary embodiments of the present invention, it is possible to perform accurate patterning even though a pattern desired to be printed is minute.

DESCRIPTION OF SYMBOLS

Figure 1:
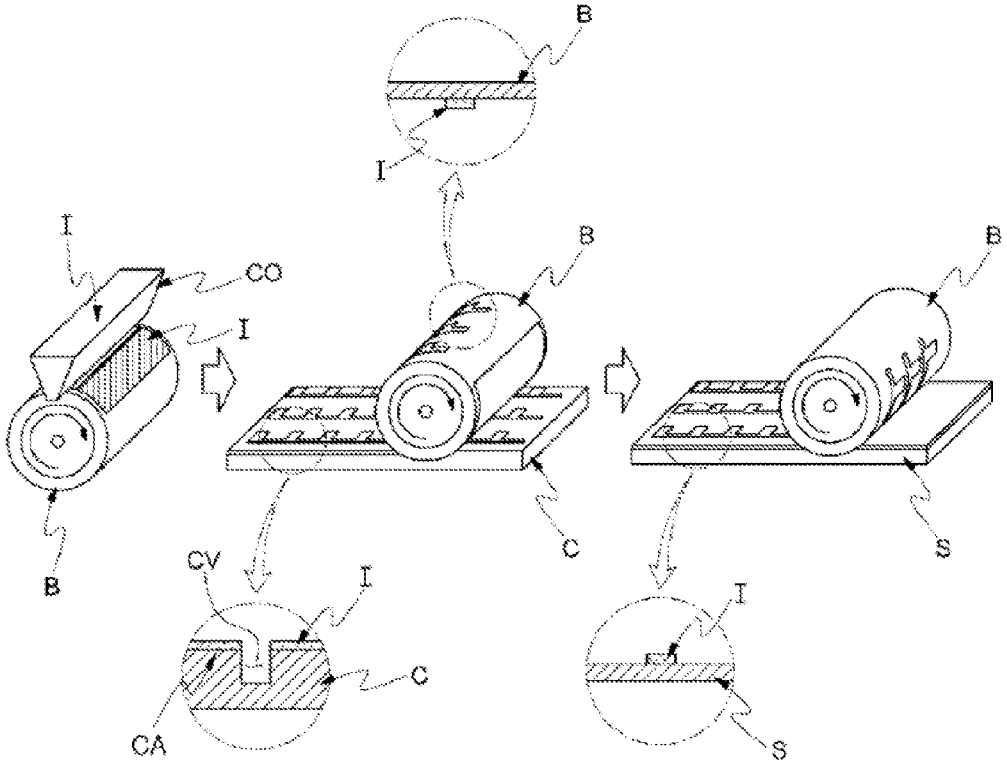
FIG.1 (Prior Art)
FIGS. 1 to 2 are conceptual diagrams describing a general reverse offset printing method.
Figure 2:
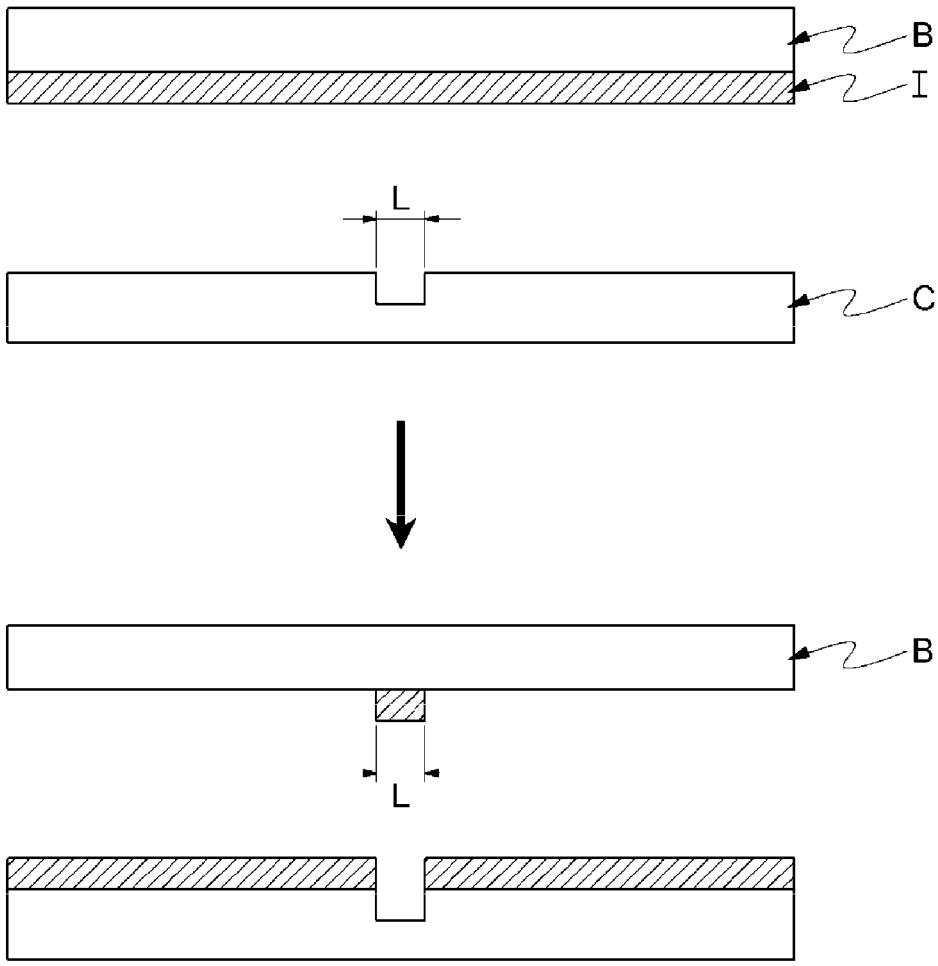

C: Cliche CV: Contact portion
S: Substrate B: Blanket

DETAILED DESCRIPTION OF THE EMBODIMENTS

Before describing various exemplary embodiments of the present invention in detail, it can be seen that applications thereof are not limited to details of configurations and arrangements of constituent elements which are described in the following detailed description or illustrated in the drawings.

The present invention may be realized and carried out by other embodiments, and may be performed in various methods.

Further, it can be seen that expressions and wordings used herein regarding such terms as directions (for example, "front", "back", "up", "down", "top", "bottom", "left", "right", and "lateral") of devices or elements are used only to simplify the description of the present invention and do not represent or mean that the related devices or element needs to have specific directions simply.

Hereinafter, exemplary embodiments of the present invention will be described in detail with reference to the accompanying drawings. Prior to the description, the terms and wordings used in the specification and the claims should not be construed to be limited to general and lexical meanings and should be construed as meanings and concepts corresponding with the technical spirit of the present invention based on a principle that the inventor can suitably define the concepts of the terms to describe his or her invention in the best way.

Thus, the exemplary embodiments described in the specification and the configurations illustrated in the drawings are simply the most preferable embodiments of the present invention and are not representative of all the technical spirits of the present invention, and thus it should be understood that various equivalents and modified examples which can replace them are present at the time when the present invention is filed.

Hereinafter, the present invention will be described in detail through the accompanying drawings and the exemplary embodiments.

The present invention relates to a reverse offset printing method, and particularly includes transferring a functional ink to a cliche C from a blanket B separately for each shear region of the functional ink I divided into the functional ink on the cliche C and the functional ink on the blanket B.

Figure 3:
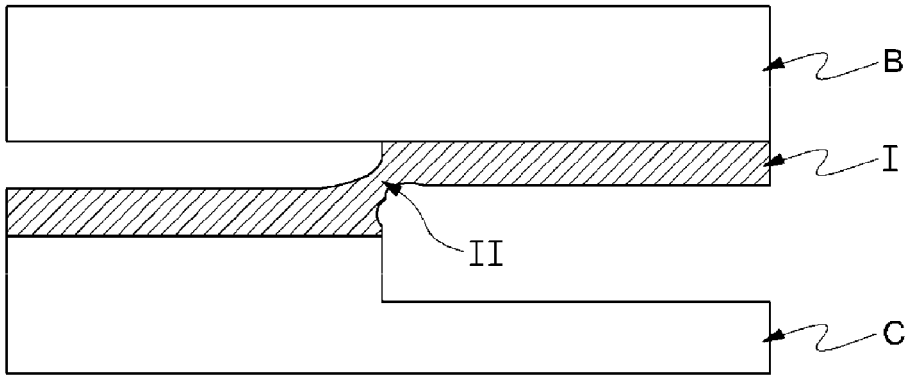
FIG. 3 is a conceptual diagram describing a problem in the related art.

In the related art, there is a method of cutting the shear region (II of FIG. 3) of the functional ink desired to be finally transferred to the substrate at a single stroke, as described above.

In this case, when the width of the pattern remaining on the blanket B is minute, the shear region is not cut and thus the pattern which should remain on the blanket B is taken to the cliche C.

The present invention has been made to resolve the above mentioned problems, and according to the present invention, shear regions of the functional ink are not separated at a single stroke, but divisibly separated for each shear region, so that a pattern desired to be finally transferred to a substrate correctly remains on the blanket B unlike the related art even though a width of the pattern remaining on the blanket B is minute, and thus precise minute printing can be achieved.

Example 1

Hereinafter, a more detailed description will be made with reference to FIGS. 4 to 5.

First, the blanket B having one surface coated with the functional ink I including shear regions Ia and Ib surrounding a pattern region 13 and a pattern region 13, is provided.

The cliche C according to the exemplary embodiment of the present invention includes a plurality of cliches so that respective shear regions are divisibly separated.

The cliche C includes a first cliche C1 having one surface on which a contact portion CV1 coming into contact with the functional ink I including one part of the shear regions is formed to remove the functional ink I on one side of the shear regions of the functional ink I, and a second cliche C2 having one surface on which a contact portion CV2 coming into contact with the functional ink I including the other part of the shear regions is formed to remove the functional ink I on the other side of the shear regions.

Figure 4:
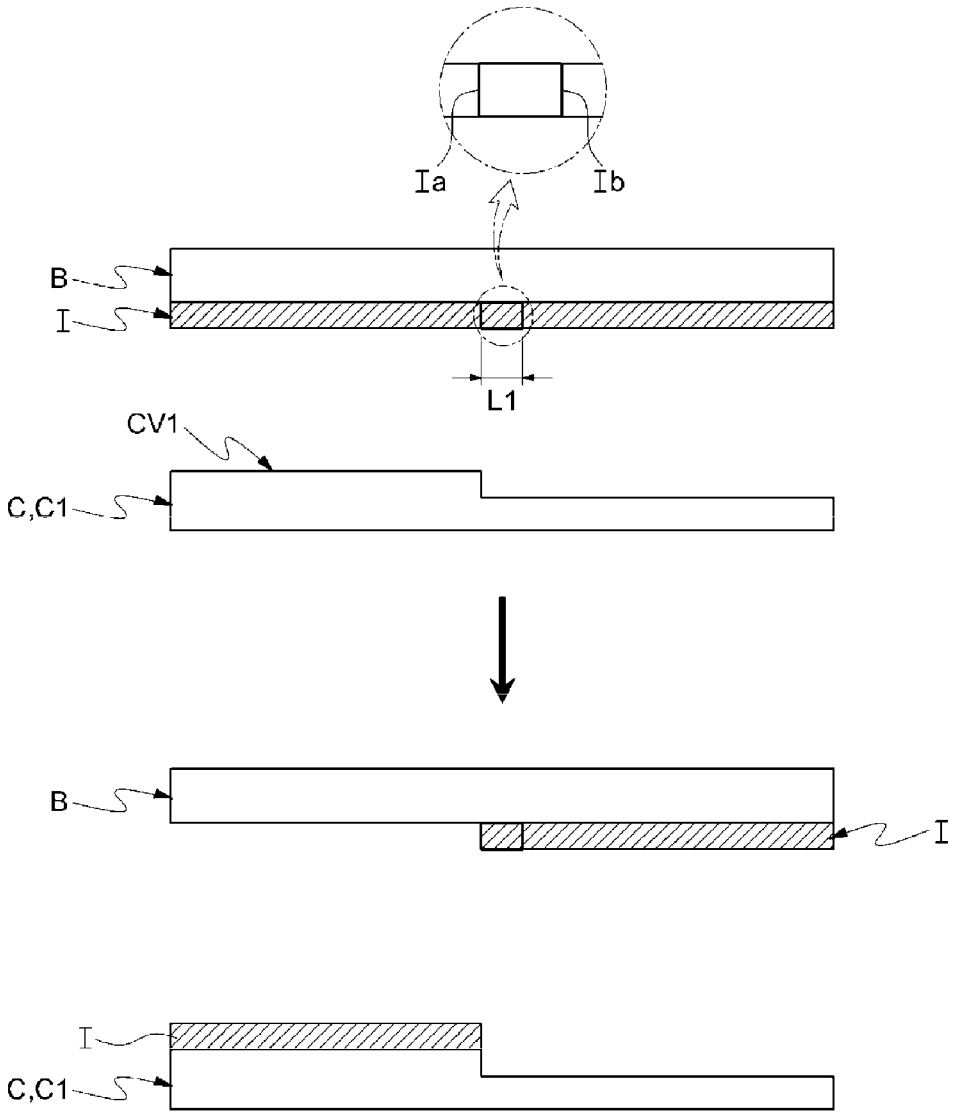
FIGS. 4 to 5 are conceptual diagrams describing an exemplary embodiment of the present invention.

That is, as illustrated in FIG. 4, the first cliche C1 is used to first remove the part corresponding to the left shear region Ia among the shear regions of the functional ink I.

To this end, the first cliche C1 is brought into contact with the blanket B in order to bring the contact portion CV1 of the first cliche C1 into contact with the functional ink existing on the left shear region Ia of the functional ink of the blanket B. In this case, a right end of the contact portion CV1 may correspond to the left shear region Ia.

The functional ink I coming into contact with the first contact portion CV1 is removed from the blanket B by separating the first cliche C1 from the blanket B.

After the functional ink of the left shear region Ia is removed by the first cliche C1, the right shear region Ib is removed from the second cliche C2.

Figure 5:
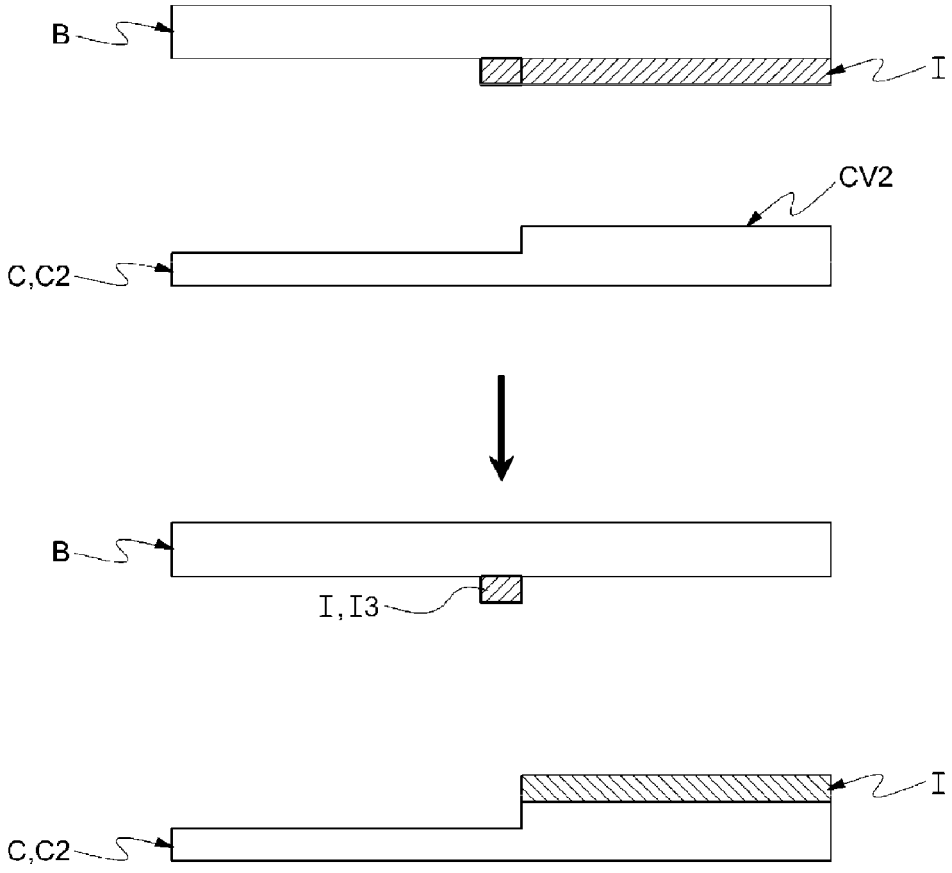

To this end, as illustrated in FIG. 5, the second cliche C2 is brought into contact with the blanket B in order to bring the contact portion CV1 of the second cliche C2 into contact with the functional ink existing on the right shear region Ib of the function ink of the blanket B. In this case, a left end of the contact portion CV2 may correspond to the right shear region Ib.

The functional ink I coming into contact with the second contact portion CV2 is removed from the blanket B by separating the second cliche C2 from the blanket B.

By the second cliche C2, only the functional ink corresponding to a pattern region I3 (a part marked with a bold line in FIGS. 4 and 5) desired to be finally transferred to the substrate remains on the blanket B.

Example 2

Figure 6:
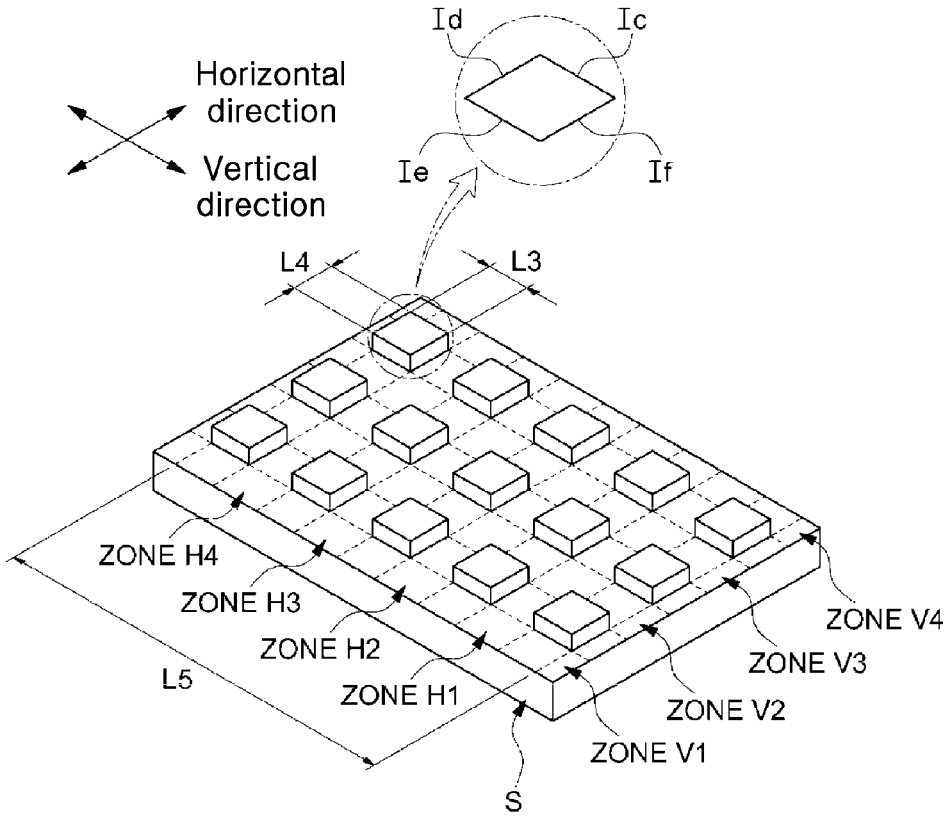
FIGS. 6 to 8 are conceptual diagrams describing another exemplary embodiment of the present invention.

Meanwhile, when the pattern region I3 desired to be finally printed is formed in a shape in which a plurality of square cross section shapes spaced apart from each other are formed on the substrate S in a grid pattern as illustrated in FIG. 6, the printing is performed as follows.

Figure 7:
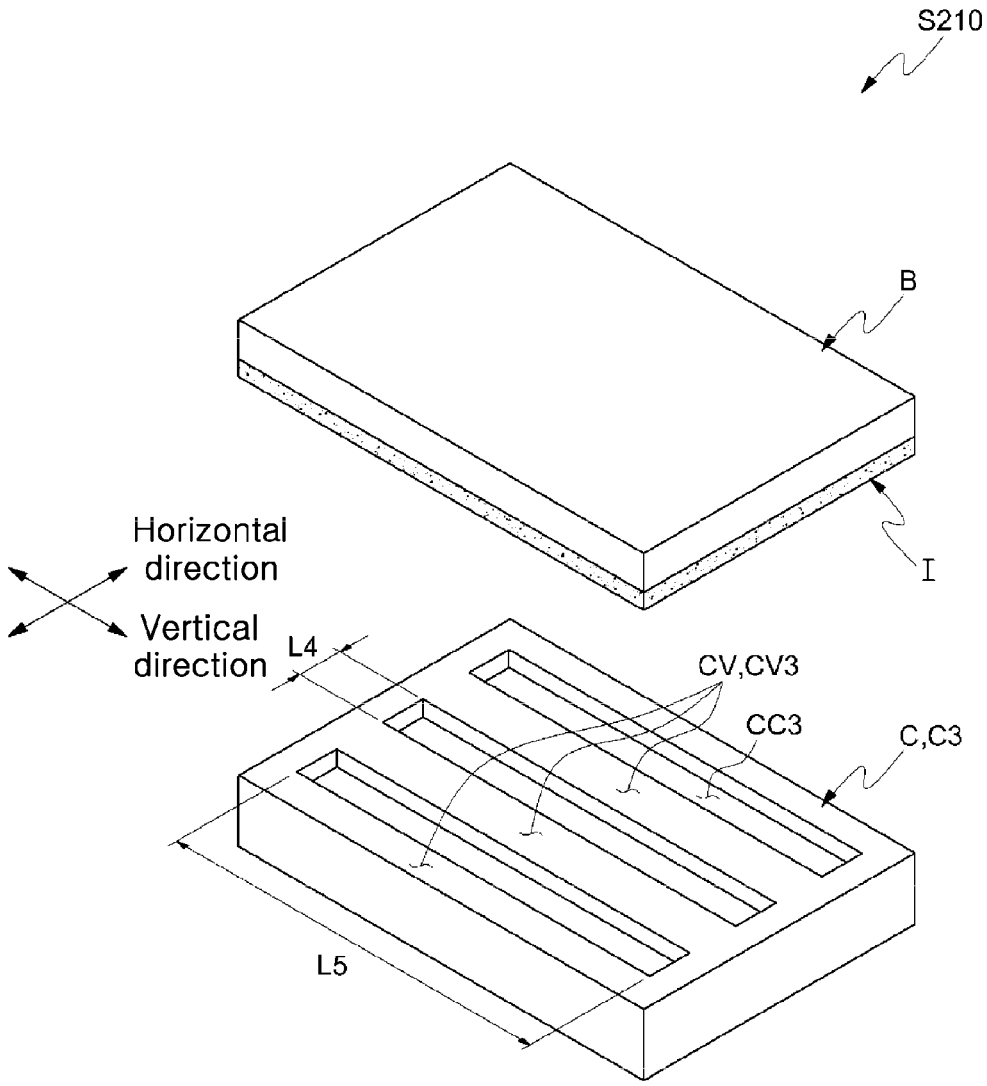

That is, a first cliche C3, as illustrated in FIG. 7, may include a plurality of contact portions CV3 formed in a horizontal direction of the grid pattern to remove the shear region of the functional ink corresponding to the horizontal direction of the grid pattern and a groove portion CC engraved between the contact portions CV3.

In this case, unnecessary functional ink is removed by bring the contact portion CV3 into contact with the blanket B, and the functional ink of the blanket B coming into contact with the groove portion CC remains on the blanket B.

That is, an unnecessary part ZONE V corresponding to the horizontal direction of the grid pattern illustrated in FIG. 6 is first removed by the first cliche C3.

In this case, the first removal of the part ZONE V corresponding to the horizontal direction means first removal of regions Ie and Ic corresponding to the horizontal direction among the shear regions having the grid pattern.

In other words, parts corresponding to the horizontal direction of the grid pattern may include four regions ZONE V1, ZONE V2, ZONE V3, and ZONE V4 as illustrated in FIG. 6. To this end, four contact portions CV3 are formed on the first cliche C3 in the horizontal direction in order to remove the regions ZONE V1, ZONE V2, ZONE V3, and ZONE V4 as illustrated in FIG. 7.

Figure 8:
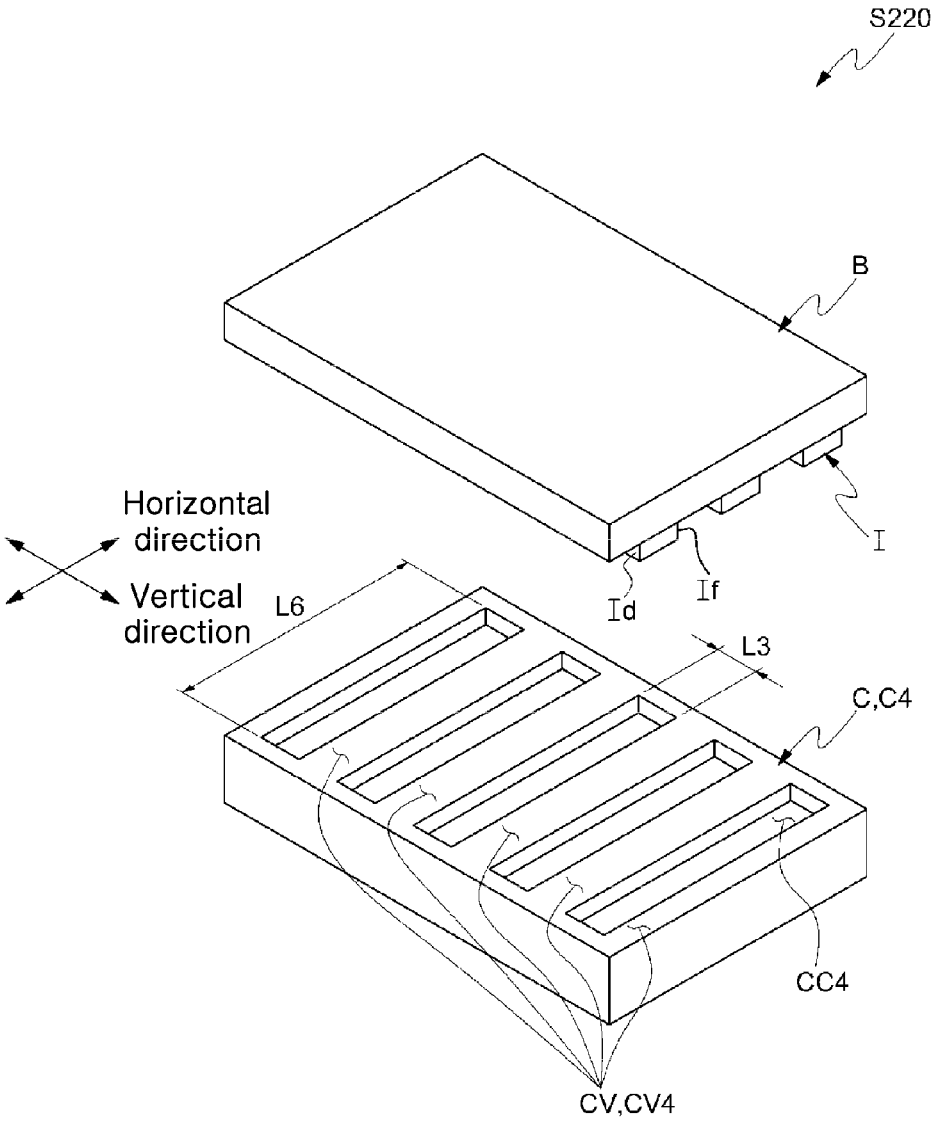

By the first cliche C3, only the shear regions in the horizontal direction of the grid pattern are first removed, and accordingly only the functional ink in the horizontal direction remains on a lower surface of the blanket B as illustrated in FIG. 8.

Particularly, as illustrated in FIG. 8, it can be identified that the functional ink remaining on the lower surface of the blanket B is first removed from two shear regions Id and If.

After only the shear regions in the horizontal direction of the grid pattern are first removed using the first cliche C3, shear regions Ic and Id (see FIG. 6) in a vertical direction of the grid pattern are finally removed using a second cliche C4 illustrated in FIG. 8.

To this end, the second cliche C4 includes a plurality of contact portions CV4 formed in the vertical direction of the grid pattern in order to remove the shear regions Ic and Id (see FIG. 6) of the functional ink corresponding to the vertical direction of the grid pattern and a groove portion CC4 engraved between the contact portions CV4.

By the second cliche C4, the pattern region having the grid shape as illustrated in FIG. 6 finally remains on the blanket B. That is, the square shape of the pattern region is formed by a region where the first groove portion and the second groove portion overlap each other.

Meanwhile, a width L4 of the groove portion CC3 of the first cliche C3 may be the same as a vertical width L4 (see FIG. 6) of the squares arranged in the grid pattern desired to be transferred to the substrate.

Further, a width L3 of the groove portion CC4 of the second cliche C4 may be the same as a horizontal width L3 of the squares arranged in the grid pattern desired to be transferred to the substrate.

Example 3

The present invention may be applied to a case where the pattern desired to be finally transferred to the substrate has a random shape as well as a case where the pattern has a particular shape as described above.

Figure 9:
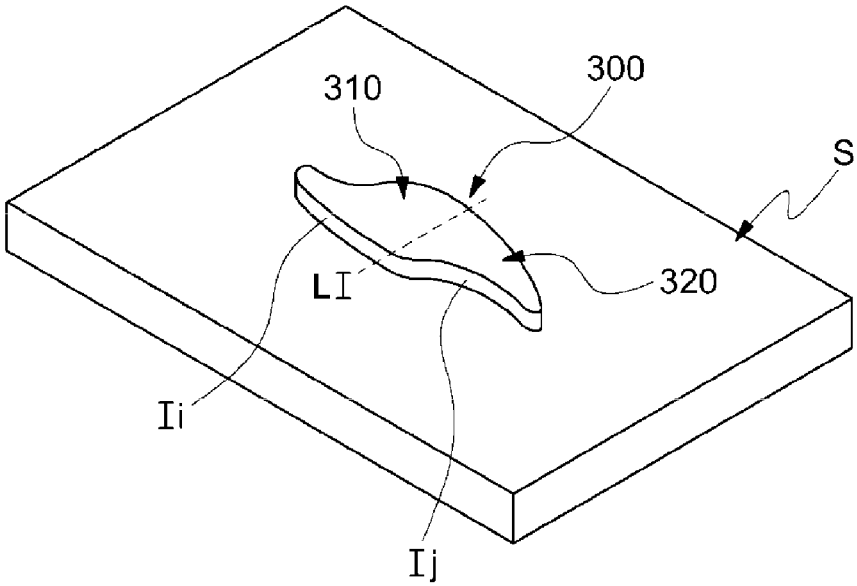
FIGS. 9 to 11 are conceptual diagrams describing yet another exemplary embodiment of the present invention.
Figure 10:
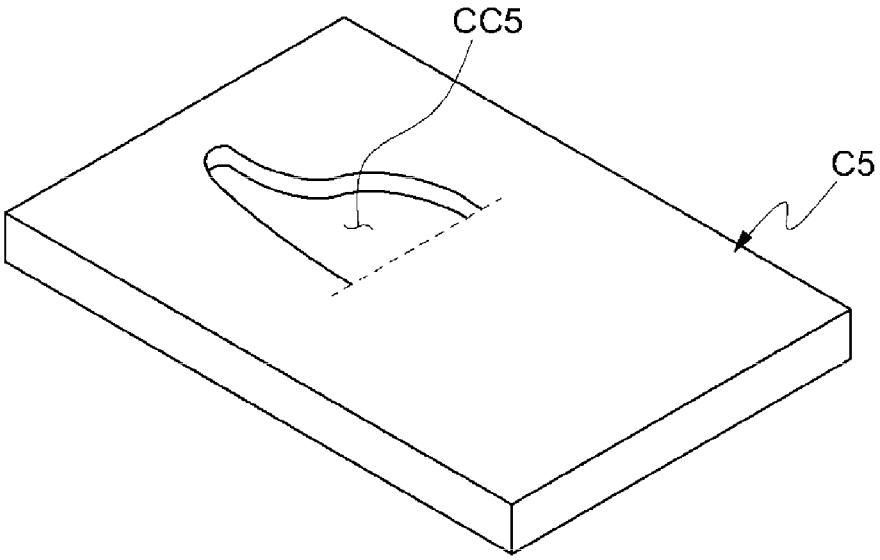
Figure 11:
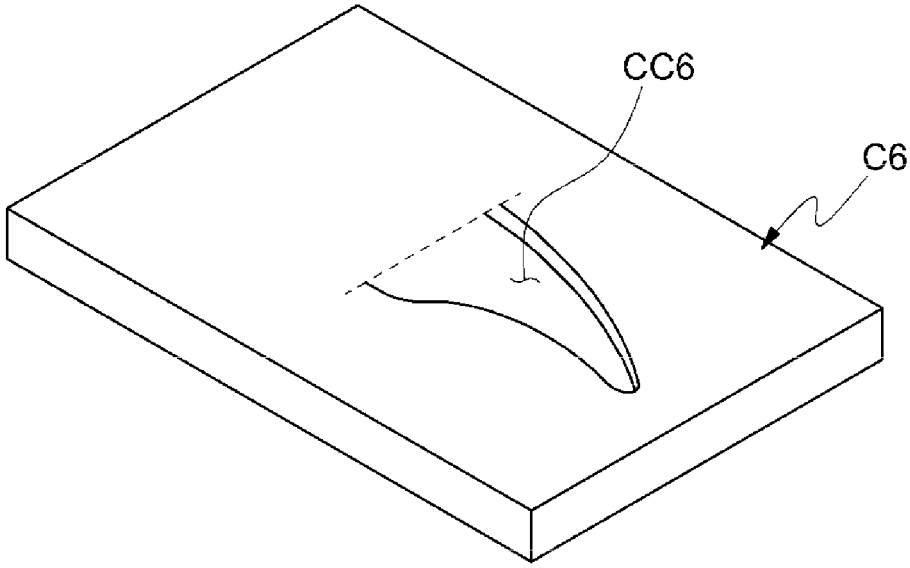

That is, as illustrated in FIG. 9, when it is desired to form a pattern 300 having a random shape on the substrate S, a first cliche C5 illustrated in FIG. 10 and a second cliche C6 illustrated in FIG. 11 may be used.

The first cliche C5 and the second cliche C6 divide the pattern 300 having the random shape by a random line LN, and then separately perform removal for respective shear regions Ii and Ij having divided shapes 310 and 320.

That is, a groove portion CC5 is formed only on a part corresponding to the shear region Ii of the first cliche C5 in order to first remove the divided shape 310 corresponding to a left side of FIG. 9.

Further, a groove portion CC6 is formed only on a part corresponding to the shear region Ij of the second cliche C6 in order to remove the divided shape 320 corresponding to a right side of FIG. 9.

By such a cliche, the random shape may also be separately removed for respective shear regions.

The pattern which a user desires may be finally transferred to the substrate S by transferring the functional ink to the cliche C separately for each shear region by using the cliche C of the present invention as described above, and then transferring the functional ink remaining on the blanket B to the substrate S.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A reverse offset printing method, comprising:

coating a blanket with functional ink;

bringing a first contact portion of a first cliché into contact with the functional ink on the blanket;

separating the blanket from the first cliché to remove the functional ink contacting the first contact portion from the blanket;

bringing a second contact portion of a second cliché into contact with the functional ink on the blanket; and separating the blanket from the second cliché to remove the functional ink contacting the second contact portion from the blanket;

wherein a first region of the functional ink including a plurality of square shapes spaced apart from each other and arranged in a grid pattern remains on the blanket after separating the blanket from the first cliché and separating the blanket from the second cliché, the first contact portion of the first cliché includes a plurality of vertical contact portions formed in only a vertical direction of the grid pattern and first groove portions engraved between the vertical contact portions, and the second contact portion of the second cliché includes a plurality of horizontal contact portions formed in only a horizontal direction of the grid pattern and second groove portions engraved between the horizontal contact portions.

2. The reverse offset printing method of claim 1, wherein a width of each first groove portion of the first cliché is equal to a horizontal width of a respective square shape.

3. The reverse offset printing method of claim 1, wherein a width of each second groove portion of the second cliché is equal to a vertical width of a respective square shape.

4. The reverse offset printing method of claim 1, wherein after separating the blanket from the second cliché, transferring the first region of the functional ink to a substrate.

* * * * *